United States Patent [19]

Paule

[11] 4,343,340

[45] Aug. 10, 1982

[54] SHUTTER SLAT CONFIGURATION

[75] Inventor: Helmut Paule, Palgrave, Canada

[73] Assignee: Prime Marketing Group, Inc., St. Petersburg, Fla.

[21] Appl. No.: 172,548

[22] Filed: Jul. 28, 1980

[51] Int. Cl.[3] ..... E06B 9/14

[52] U.S. Cl. ..... 160/232; 160/235; 160/236

[58] Field of Search ..... 160/232, 236, 235, 133

[56] References Cited

U.S. PATENT DOCUMENTS

| | | | |
|---|---|---|---|
| 546,858 | 9/1895 | Kinnear | 160/232 |
| 1,081,202 | 12/1913 | Brunst | 160/235 X |
| 1,579,839 | 4/1926 | Raper | 160/236 X |
| 1,707,287 | 4/1929 | Sudzki | 160/232 |
| 2,850,332 | 9/1958 | Begle | 160/235 |
| 4,197,896 | 4/1980 | Reichstadt | 160/133 |

FOREIGN PATENT DOCUMENTS

| | | | |
|---|---|---|---|
| 236093 | 10/1964 | Austria | 160/232 |
| 627662 | 5/1963 | Belgium | 160/232 |
| 629683 | 7/1963 | Belgium | 160/232 |
| 81863 | 6/1895 | Fed. Rep. of Germany | 160/235 |
| 1509513 | 11/1969 | Fed. Rep. of Germany | 160/133 |
| 2505682 | 8/1976 | Fed. Rep. of Germany | 160/236 |
| 2506610 | 8/1976 | Fed. Rep. of Germany | 160/133 |
| 2322254 | 3/1977 | France | 160/236 |
| 596982 | 8/1959 | Italy | 160/133 |

*Primary Examiner*—Rodney H. Bonck
*Attorney, Agent, or Firm*—Laurence R. Brown

[57] ABSTRACT

A shutter assembly is made of adjacent interlocked extruded plastic slats having a hollow generally rectangular body with extending tongue and channel interlocking members. Provision is made for locking slats in mated position against longitudinal movement and for a metallic end bearing surface providing long wear under heavy use.

The slat structure is ribbed to remove rain water that may tend to pass through a shutter and for adding strength and can receive strengthening rods as desired in a mating internal female cell structure.

5 Claims, 5 Drawing Figures

SHUTTER SLAT CONFIGURATION

TECHNICAL FIELD

This invention relates to shutters or blinds made of a plurality of adjacent interlocking slats, and more particularly it relates to the slat configuration.

BACKGROUND ART

Rolling shutters constructed of a plurality of interlocking slats are well known in the art as evidenced by the following U.S. Patents:

Krueger—U.S. Pat. No. 2,235,220—Mar. 18, 1941

Piana—U.S. Pat. No. 3,642,050—Feb. 15, 1972

It is known as taught in U.S. Pat. No. 4,042,005—Hammerstein—Aug. 16, 1977, and U.S. Pat. No. 4,173,247—Piana—Nov. 6, 1979 to form slats of extruded plastic materials in various configurations.

However, all such known prior art configurations have various problems and deficiencies solved by the present invention.

One basic requirement of a shutter is to keep out wind and rain. Because a plurality of slats are in contiguous contact at upper and lower edges a crease is formed into which water tends to accumulate as it runs down the outside shutter surface and to blow inside the shutter. This problem has not effectively been solved by prior art slat configurations.

Another problem of prior art slat configurations is that they are difficult to confine in end channels and tend to wear, bend or otherwise become damaged with extensive movement.

Another problem of prior art shutter configurations is that the individual slats tend to shift longitudinally and thus can bind or become damaged as they are raised and lowered.

Another problem with prior art shutter assemblies, particularly those using extruded plastic slats, is that the outer weather surface is weak and can become distorted in the presence of heavy winds.

Still another problem with some complex prior art shutter assemblies is that they are not readily cleanable both inside and outside because of inaccessible creases or complex surfaces into which dirt may accumulate.

It is therefore an object of this invention to correct the foregoing problems in prior art shutters and to produce improved shutters capable of long maintenance free use.

Further features, objects and advantages of the invention will be made evident throughout the following drawing, description and claims.

DISCLOSURE OF THE INVENTION

Accordingly there is provided by this invention an improved slat configuration which interlocks in a shutter assembly to resolve the aforesaid problems of the prior art.

The slat is preferably made in the form of an extruded plastic hollow body generally rectangular in cross section. Opposed side walls form interior and exterior shutter surfaces. Mating tongue and channel interlocking elements extend from the two ends of the rectangular body. The outer shutter surface of each slat has a zigzag surface configuration providing a plurality of ribs on each slat to permit water running down the exterior shutter surface to drip off the ribs. Preferably a rib terminates near the lower edge of the slat to let water drip off instead of running down the surface past the seam between two adjacent slats.

The interior of the hollow rectangular body is divided into three successive closed cells formed by two integral panel members extending across the hollow body from wall to wall. The intermediate cell is longer than the outer cells and has two flanges extending internally from the walls near each end of the longer cell.

This structure accordingly receives in frictional contact with the interior of the hollow body and the flanges a skeletal strengthening rod if desired along the length of selected slats, such as an H-shaped aluminum extrusion. Furthermore, a special metallic, preferably tempered aluminum, $\pi$-shaped end fitting frictionally fits with legs inserted between the flanges and the ends of the intermediate cell (over the strengthening rod if desired) and extends from the ends of the slats. This end fitting serves as a bearing surface to ride in a guiding channel.

For purposes of preventing sliding of the slats relative longitudinally relative to each other a locking arm extends from the $\pi$-shaped end fitting over the interlocked end members of two interlocked slats. The interlock structure is such that the slats are assembled by longitudinally inserting the tongue of one slot into the channel of the adjacent slat. The end locking arm therefore confines the mated interlock members to avoid any substantial longitudinal displacement of the slots.

To permit rolling up of the slats for storage, the tongue and channel members having mating semi-cylindrical elements. The cylinder of the tongue member is connected by a slotted panel to the hollow body to allow the shutter to pass some sunlight and air in a semi-closed position.

BRIEF DESCRIPTION OF THE DRAWINGS

In the drawings:

FIG. 4 is a partial fragmental perspective view of one end of a shutter assembly embodying the invention of which

DESCRIPTION OF A PREFERRED EMBODIMENT

Figure 1:
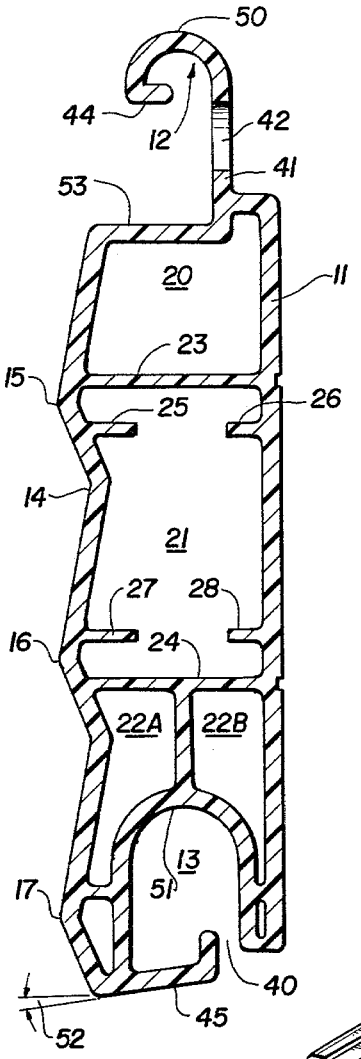
FIG. 1 is a cross section end view of a slat for a shutter assembly as constructed in accordance with this invention.

As may be seen in the cross section view of a single slat 10 used to form a shutter assembly set forth in FIG. 1, a preferably plastic extrusion provides a hollow body section 11 of generally rectangular shape. Extending from opposite ends of the hollow body are the respective mating tongue 12 and channel 13 interlocking members.

The slat has an outer weather surface 14 of zig-zag surface configuration to provide a plurality of protruding ribs 15, 16, 17 on each slat. It may be seen that these ribs permit rain to run down the outer surface and drip from the ribs, thereby decreasing the chances for water to accumulate at a seam between two slat where it can be blown inside the shutter. This ribbed structure also provides strengthening of the outer surface so that if it is hit by foreign objects such as tree limbs or rocks, damage to the shutter is less likely. The inner surface of the slat assembly is substantially straight, so that it can be readily cleared. The inner hollow body of the slat has three successive closed cell regions 20, 21, 22 (22A and 22B) formed by two integral panel members 23, 24 extending across the hollow body between the side walls. The intermediate cell region 21 is longer than the outer cell regions 20, 22 and has a pair of internally extending flanges 25, 26 or 27, 28 near each end of the cell adjacent the walls 23, 24 respectively.

Figure 2:
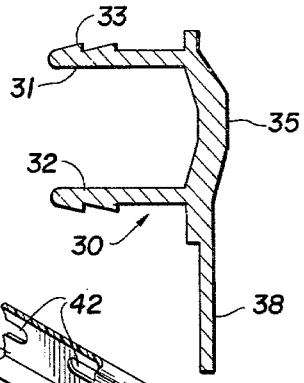
FIG. 2 is a cross section side view of a metallic slat end bearing and locking member afforded by this invention.
Figure 3:
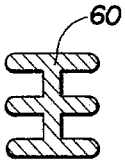
FIG. 3 is a cross section end view of a strengthening rod afforded by this invention.
Figure 4:
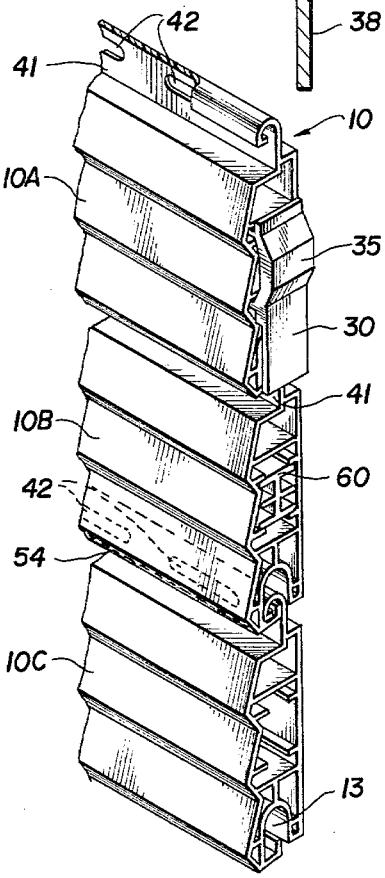

These flanges 25–28 serve to strengthen the rigidity of the slat, but more important they serve as a frictional female receptacle for receiving the two members shown in FIGS. 2 and 3, as seen by the view of FIG. 4.

Thus, the $\pi$-shaped bearing and locking member 30 of FIG. 2 has two legs 31, 32 with barbs 33 for holding the legs in the end of the slat. Thus flanges 25–28 and walls 23, 24 of the slat respectively form two female receptacles for receiving the legs 31, 32 in frictional engagement and mating registration.

Figure 4A:
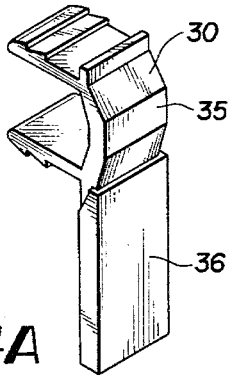
FIG. 4A depicts the end bearing member of FIG. 2 riding in a channel member for guiding and framing the shutter assembly.

The bearing portion of member 30 comprises the ridge 35 which is adapted to ride in a mounting frame or channel 36 (FIG. 4A). Thus, the member is preferably made of an extruded and tempered aluminum. Thus, the slats and shutter assembly are simply mounted and guided without problems encountered in channelling the ends of the slat housing 10.

In addition the locking arm 38 extends from the $\pi$-shaped member 30 for riding down over the cells 22A, 22B and channel 13 to serve as a locking member to confine the tongue member 12 without significant end play so that the adjacent slat members cannot slide relative to each other, as best seen from FIG. 4. The configuration of the channel 13 is such that opening 40 accommodates the panel section 41 of the tongue extension 12 for a degree of vertical motion along the length of the slat body, but requires the adjacent slats to be assembled by sliding together from the ends. Thus, with lock members 30 in place at each end of a slat the slats cannot move longitudinally relative to each other but can move over a range of positions vertical to the slat body.

This permits the panel 41, with slots 42 to be disposed at the juncture of two adjacent slats 10 if desired to permit entry of some light and air through the slots 42. In such position the substantially diametrical flange 44 of tongue member 12 will rest on the mating flat inner surface of the L-shaped channel extension member 45. The flange 44 and L-arm then produce a weather seal ridge assembly.

At the opposite end of the range of movement between adjacent slats as seen from 10B and 10C of FIG. 4, the semi-cylindrical tongue portion 50 rests in the mating semi-cylindrical surface 51 of the channel member 13. Thus the flat surfaces of the L-shaped channel member 45 preferably slightly tilted up at angle 52 will engage the flat surface 53 of the upper end of the generally rectangular slat body 11 to form a substantially closed mated seam 54 (FIG. 4) between two adjacent slats where flange 41 serves as a weather barrier stop to prevent water from passing through the shutter assembly.

As seen from FIGS. 3 and 4, a metal, preferably tempered aluminum rod 60 of generally H-shaped configuration or the like, frictionally fits into the intermediate cell 21 between the respective flange paris 25, 26 and 27, 28. This strengthens the slats where necessary against bending, giving longer slats considerable rigidity, and yet is compatible with the use of the bearing and locking member 30 frictionally mounted in the same cell 21.

It is evident therefore that an improved shutter slat configuration and shutter assembly is provided by this invention providing superior operation over the prior art.

By the zig-zag step down outer surface configuration of the slats formed by ribs 15, 16, 17 or the like, shutters can be made more weather proof than those of the prior art.

Because of the end bearing and locking members 30 shutters are made long wearing with extensive use and easy to confine in framing channels and the shutter slats cannot move laterally to cause binding and problems of end leakage, etc.

Also the outer and inner shutter surfaces are easy to clean with simple surfaces and without accumulation of dirt.

In addition the slats and shutters made therefrom are strong enough to withstand heavy storms and impact without leakage or damage.

Therefore this invention has for the first time incorporated a plurality of novel features into a coacting combination which affords new functions and performance not heretofore available in the art without the specific novel contributions of this invention.

INDUSTRIAL APPLICATION

Extruded plastic slats for forming shutter assemblies of the roll down type are provided with several advantageous features of withstanding impact, keeping out water leakage and presentation of simple surface areas for each in cleaning. Interlocking assembly structure provides for partial opening with limited air and light transversal and weathertight closed position. The slats have an improved end bearing assembly for simplified framing for long life with extensive use. Also the slats are confined to prevent end play and are adapted to receive strengthening internal rods optionally where long slats or added strength are required.

I claim:

1. A slat configuration for a shutter assembly comprising in combination, an extruded hollow body generally rectangular in cross section having two interlock members extending from opposite end surfaces to form mating tongue and channel interlocking elements respectively and one side having an outer zig-zag surface configuration providing a plurality of at least three ribs on each slat, having in said hollow body three successive closed cell regions formed by two integral panel members extending across the hollow body from wall to wall substantially at rib positions with the intermediate cell longer than the outer two and formed with internally extending flanges near each end thereof defining a central compartment with slots at either end thereof wherein the channel interlock member comprises a half cylindrical structure from which extends an L-shaped extension substantially closing the half cylindrical structure so that entry of the interlock tongue member is only permitted from the ends of the slat and wherein the hollow body terminates in two end pieces one comprising said L-shaped extension substantially perpendicularly disposed to the side walls and arranged to meet face to face to form a substantially weathertight crease along the zig-zag surface directly below an adjacent said rib when two adjacent slats are interlocked in closed position, thereby to allow rain to run downwardly off the zig-zag outer surface ribs without penetration to the inside of an assembled shutter configuration of a plurality of adjacent slats.

2. The slat configuration defined in claim 1 having a skeletal rod substantially H-shaped fitted into said central compartment of the slat in frictional contact with said flanges.

3. The slat configuration defined in claim 2 having a $\pi$-shaped end bearing metallic member having its two legs fitted into the end of said slat in frictional engagement between the slots formed by the flanges and walls of said intermediate cell thereby longitudinally retaining the rod in place.

4. The slat configuration defined in claim 1 having a $\pi$-shaped retainer member disposed with its two legs fitted into said slots and provided with an extension locking arm on the $\pi$-shaped end member extending perpendicular to the slat length to cover one of said interlock members thereby producing an end limit position for two adjacent interlocked slats.

5. The slat configuration defined in claim 1 wherein the tongue interlock member comprises a panel extending normally from the hollow wall at an intermediate position and presenting a curved end formed into a half cylinder with a substantially diametrical flange directed toward the center of the cylinder for mating with said L-shaped extension.

* * * * *